US011434657B1

(12) United States Patent
Gross, Jr.

(10) Patent No.: US 11,434,657 B1
(45) Date of Patent: Sep. 6, 2022

(54) PROTECTIVE COVER FOR FRAME TENT FITTINGS

(71) Applicant: William Edward Gross, Jr., Columbia Falls, MT (US)

(72) Inventor: William Edward Gross, Jr., Columbia Falls, MT (US)

( * ) Notice: Subject to any disclaimer, the term of this patent is extended or adjusted under 35 U.S.C. 154(b) by 0 days.

(21) Appl. No.: 16/847,474

(22) Filed: Apr. 13, 2020

Related U.S. Application Data

(60) Provisional application No. 62/920,086, filed on Apr. 12, 2019.

(51) Int. Cl.
*E04H 15/54* (2006.01)
*E04H 15/64* (2006.01)
*E04H 15/48* (2006.01)

(52) U.S. Cl.
CPC ..... *E04H 15/54* (2013.01); *E04H 15/48* (2013.01); *E04H 15/64* (2013.01); *Y10T 403/34* (2015.01)

(58) Field of Classification Search
CPC ..... Y10T 403/34; Y10T 403/341; Y10T 403/342; Y10T 403/347
USPC ..... 135/120.3, 909
See application file for complete search history.

(56) References Cited

U.S. PATENT DOCUMENTS 1,092,217 A * 4/1914 Hopkins ..... A63H 33/042 446/102
1,347,808 A * 7/1920 Franklin ..... A63H 33/108 403/119
2,696,396 A * 12/1954 Pittaluga ..... A63G 9/12 403/171
3,424,178 A * 1/1969 Yoshimi ..... E04H 15/44 135/157
3,559,694 A 2/1971 Volberg
3,682,504 A 8/1972 Brimberg
3,740,084 A * 6/1973 Tellberg ..... F16B 7/0486 403/171
3,830,011 A * 8/1974 Ochrymowich ..... A63H 33/102 446/126
4,039,263 A 8/1977 Bassler
4,133,151 A * 1/1979 Burvall ..... E04B 1/26 403/171

(Continued)

FOREIGN PATENT DOCUMENTS

FR 1264771 A * 6/1961 ..... E04H 15/32

*Primary Examiner* — David R Dunn
*Assistant Examiner* — Danielle Jackson
(74) *Attorney, Agent, or Firm* — Law Office of Craig Bohn; Craig E. Bohn

(57) ABSTRACT

The tent frame fitting cover is a durable, self-restraining structure serving to smooth the harsh upper surfaces of the tent frame joint and protect the fabric of the tent canopy. After snapping on, the cover holds itself in place by friction fit on the tent frame and encapsulates hardware, including pins and bails, and tubing. The cover includes a central body and a plurality of projections. The projections extend in various directions from the tent fitting, tracking with the tent frame member components. Many cover embodiments are provided to accommodate many tent junction variations. By heat pressing, the projections are initially formed into arms that wrap and secure the cover structure to the tent tubing. The thermo-formed material retains the initial shape in a flexible manner to allow pressing installation and prying removal of the cover from the tent. The cover increases tent installation efficiency and extends canopy life.

8 Claims, 11 Drawing Sheets

(56) References Cited

U.S. PATENT DOCUMENTS

| | | | | | |
|---|---|---|---|---|---|
| 4,840,201 | A * | 6/1989 | Botsolas | F16L 59/11 | 285/915 |
| 4,932,257 | A * | 6/1990 | Webb | B29C 66/5221 | 285/123.1 |
| 5,226,440 | A | 7/1993 | Fuhrman | | |
| 5,700,102 | A * | 12/1997 | Feleppa | A47B 47/0016 | 403/170 |
| 6,108,984 | A * | 8/2000 | Davidson | E04B 1/3211 | 403/171 |
| 6,892,503 | B1 * | 5/2005 | Kang | E04H 15/34 | 403/170 |
| 6,896,437 | B2 * | 5/2005 | Morgan | E04H 17/1447 | 403/188 |
| D533,914 | S * | 12/2006 | Diaz | D21/839 | |
| 7,146,995 | B2 * | 12/2006 | Lapping | E04H 15/44 | 135/121 |
| 7,448,400 | B2 | 11/2008 | Jensen | | |
| D630,930 | S * | 1/2011 | Jones | D8/349 | |
| 7,992,353 | B2 | 8/2011 | Athan | | |
| 8,434,196 | B1 * | 5/2013 | Murphey | H01Q 15/161 | 16/225 |
| 2009/0188207 | A1 | 7/2009 | Gordin et al. | | |
| 2013/0206198 | A1 | 8/2013 | Kouzmanoff et al. | | |

* cited by examiner

--PRIOR ART--

PROTECTIVE COVER FOR FRAME TENT FITTINGS

CROSS-REFERENCE TO RELATED APPLICATIONS

This patent application claims priority under 35 U.S.C. SS 119(*e*) to U.S. Provisional Patent Application Ser. No. 62/920,086, entitled "Qwik Cover", and filed on Apr. 12, 2019, which application. The entire disclosure of that provisional patent application is hereby incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

This invention relates to frame tents and particularly canopies for frame tents and more particularly methods and accessory devices for expediting canopy installation, prolonging canopy life, and protecting a canopy during installation and use.

2. Description of the Related Art

Conventional tent, awning, and canopy frame structures of a readily assemblable and disassemblable nature are frequently utilized in the rental trade. Tent frames include support legs, beams, and similar frame components, a subset of which make up a top assembly for receiving a tent canopy. Tent frames are commonly made up of cylindrical tubing. Various types of junction elements or connectors, or so-called slip fit or slip-on fittings join the cylindrical tubing together and the frame components are typically secured to one another with hardware.

As one example, a pyramid-shaped top assembly can illustrate how the various frame structures work together. In these tents, the top assembly is supported by sixteen leg beams. Sixteen perimeter beams form the square perimeter of the top assembly. Four hip rafter beams and four rafter beams support the canopy of the frame tent. A central crown fitting, in this type of tent, an eight-way fitting, connects hip rafter beams and rafter beams at the crown of the frame tent. The central crown fitting is a special type of end crown fitting, as it connects two hip sections of the tent. Corner fittings connect two perpendicular perimeter beams, a hip rafter beam, and a leg beam. Side eave fittings connect perimeter beams that form a side of the top assembly, a rafter beam, and a leg beam. The two halves of the frame tent are known as hips or hip ends; this type of frame tent consists of two hip sections with no mid-sections. Some versions of the Qwik-top® tents, discussed further below, also use a hip-style frame configuration.

Another type of conventional frame tent top assembly comprises one to an unlimited number of mid-sections that connect with hip sections. Hip ends and additional leg beams support the top assembly. This frame tent-style includes perimeter beams and eight to twelve hip rafter beams. Ridge beams run along the top of mid-sections. End crown fittings, in many instances six-way fittings, connect two hip rafter beams, three rafter beams, and a ridge beam. The mid-crown fitting is a four-way fitting in this case and it connects two rafter beams and two ridge beams. In certain cases, fittings with more connections can be used in place of fittings with fewer connections. For example, an eight-way fitting can sometimes be used when six connection points are needed. End eave fittings and side eave fittings each connect two perimeter beams, a rafter beam, and a leg beam. Other conventional tents include the examples shown at the Aztec Tents website and in U.S. Pat. No. 5,226,440, incorporated by this reference.

Qwik-top® tents are offered in widths including 10', 15', 20', 30' and 40' and expandable lengths of 10', 15', and 20'. See diagrams for each tent width at https://www.aztectent-.com/products/qwik-top, each diagram incorporated by this reference. Larger tents, whether conventional or Qwik-top®, may require additional beams and fittings and may also require beams to be split into two or more parts. They may also include hip rafter support beams, which connect a hip eave fitting with a hip rafter beam. The hip rafter beam can be split into two sections or can comprise one continuous beam with a midpoint slide hip fitting. Because of the hip rafter support beams, the hip eave fittings in these tents generally have six-way connections but small frames require fewer hip rafter support beams so an alternative fitting with fewer connections could be used. As an example, a 30' wide unit will include one set of hip brace pipes extending from hip fitting down to the perimeter so a four-way connection could be possible. Alternatively, a 40' wide until will include a secondary set of hip brace pipes extending from the hip fitting to the perimeter; therefore requiring a six-way connection, having two connections for the hip rafter beam and four connections for the support beams.

Fittings that serve as connections to join various portions of the tent frame together may be powder-coated steel. One common type of fitting is a west coast fitting and some are commonly termed corner, ridge intermediate, intermediate, three-way crown, four-way crown, six-way crown and eight-way crown fittings, fabricated of 1.66" OD aluminum or steel tubing. Frame tents frequently use one or more fitting connection systems.

To assemble a given tent structure, it is conventional to use 2" OD cylindrical tubing with ⅛" inch wall thickness in appropriate lengths to make up the uprights, eave, and hip rafters and, where used, intermediate rafters with the various rafters being interconnected by a crown fittings at the ridge or peak or peaks or by corner or intermediate fittings at the eave beams. One type of tent discussed below is a Qwik-top® tent and it uses, as do many other frame tents, a framework of 6061-T6 Anodized Aluminum frame system with powder coated steel fittings. Frame poles may serve as hip rafter beams, rafter beams, and ridge beams. The pin and hole system described below allows fittings such as crown fitting to connect to both rafter beams and hip rafter beams. Conventionally, the tubes and fittings are joined together in a telescoping manner with the tubes telescoped over associated arms of the fittings and the tubes and fittings are interlocked together by so-called locking quick pins. See illustration of prior art shown in FIG. 19.

Whether used on crown fittings or other fittings, pin and hole attachment systems are typically used to secure sections of the tent frame to one another. The pin and hole system is one attachment system capable of use with a crown fittings. See, for example, the prior art pin and hole system shown in FIG. 19. One frame tent system that utilizes a slightly different pin and hole system is the Aztec Tents Qwik-top® Tent system. Pins used with the Qwik-top® tents include Acadapin or assembly pins, which have bails or baskets. This style of pin and bail combination is utilized for a wide variety of fastening applications but most commonly for round 2"OD aluminum tubing. Constructed of zinc plated steel this pin is 0.250" in diameter and the wire bail is designed for a maximum of 2.025" wide material. The top of the bail measures 1.025" from the center of the pin. Another pin used in tent assembly is the jumbo pin, an "R" shaped pin utilized for a wide variety of fastening applications but most commonly for round 2"OD aluminum tubing and Frame Tent Pipe aluminum framing. Finally, a pin safety can be used in tent assembly. This pin comes in various sizes and has a square bail. It is utilized for a wide variety of fastening applications. Constructed of zinc plated steel this pin is 0.365"-0.500" in diameter and the wire bail is designed for a maximum of 2.125"-2.45" wide material. The top of the bail measures 1.710"-1.890" from the center of the pin. Another embodiment comprises a nut and bolt connection. Attachment systems can also comprise swivel pieces so as to enable connection to slanted or horizontal beams. Several other attachment systems or attachment combinations are also possible.

Pins are used in conjunction with pin holes in the fittings and/or frame beams and legs. The attachment end pieces are inserted into slots such that the pinholes are aligned, and pins are inserted through the holes to secure the connection between the frame poles and the fitting. While addressing the goal of affixing the frame together, the tent canopy is exposed to this hardware during installation and use. Tent hardware must be cleaned regularly to keep the hardware components clean and free of dirt, oxidation, and other chemicals. Rust of the frame and black oxidation of anodized aluminum components can cause staining to any fabric components that come in contact with the pole or component during installation, use, or take-down. Great care must be taken to avoid transfer of contaminants on the surface of the hardware and frame to the fabric in order to prevent permanent staining or damage to the fabric membrane.

The tent canopy is generally connected to the top assembly using mechanisms such as buckles, lashes, or latches and may be tensioned with ropes, or inserted in frame tracks, or otherwise secured to the tent frame. Sometimes frame tents include walls and doors of flexible material. One common frame tent system is the Azetc Tents Qwik-top® Tent system, see "Qwik-top® Ten/Product Manual https://www.aztectent.com/sites/default/files/product-resource-files/Product%20Manual_Quik%20Top.pdr. The Qwik-top® Frame Tent utilizes tensioned-valance technology to create a tighter fitting tent top. By using the tensioned valance Qwik-top® tents eliminate the traditional "buckles" used to attach the top to the frame, thus greatly reducing installation time and offering a better performing covering in foul weather. Because the Qwik-top® frame is identical to an existing, standard expandable design frame, that frame can be converted to the Qwik-top® system by simply replacing the top and adding Qwik™ Baseplates. The Qwik-top® system is available in one-piece, non-expandable versions, as well as expandable versions with a lace or metal clasp connection. See /https://www.aztectent.com/products/qwik-top. These materials published by Aztec Tents are incorporated by reference herein in their entireties.

The Qwik-top® tent canopies are typically made of flame retardant materials and include fabric of 16-ounce PVC laminated blockout white standard membrane, transparent clear, and other colors. Tent covers can be made from a variety of materials, including but not limited to canvas, cloth, polyethylene, nylon, polyester, vinyl, vinyl-coated polyester, acrylic materials, or any number or combination of other materials. Tent tops are designed such that a tent roof or canopy (used interchangeably herein) can be installed by sliding it over the top assembly of the tent. Repetitive installations result in significant wear and tear to the tent roof fabric. Normally, tent roofs come in different sections and those must be lashed together immediately before or during installation. See, for example, www.aztec-tent.com/products/quik-top, pages 13-14, steps 19-24. The many steps to connect the canopy represent a significant portion of the installation time and complexity in an already time-consuming and difficult task.

Frame tents are frequently used at venues for weddings or gatherings that required that they only be in place for one day. However, many dedicated venues may keep frame tents in place for a season or all year. Frame tents also find many uses in the construction field or the medical industry, which requires that they remain installed, many times in extreme weather conditions, for many months. Other applications of framed tents include amusement parks, commercial buildings, complexes, hangers, space stations, playgrounds, and resorts, for example.

Whether reinstalled frequently or left in place for a period of time, the tent canopy is the most vulnerable aspect of the frame tent and endures significant wear and tear. A primary challenge when installing large tents is keeping the tent off the ground. The tent canopy fabric should not contact the ground. Any contact with the ground increases abrasion to the tent canopy, which will cause unsightly blemishes and diminish the canopy's life. The ground can leave residue on the canopy, which can increase the chance of mildewing of any moisture on the fabric. Additionally, hardware, junctions, and abrasions will harm tent canopies, which may get snagged on tent pins and/or fittings. Small impediments, sharp objects and rough surfaces all have the potential to damage the tent fabric membrane and compromise the integrity and longevity of the canopy materials. Even after successful installation, abrasions sustained by the tent canopy at the regular stress points lead to excessive damage to the very expensive tent canopy. For this reason, large, protective cloths must be placed under the canopy to protect it from the ground and the tent frame during installation and also during cleaning.

BRIEF SUMMARY OF THE INVENTION

The cover of the present invention is a three-dimensional, durable, self-restraining structure that snaps onto a tent frame over the frame-fitting junction or joint. It comprises a central body sized and formed to overlay a tent joint fitting, a plurality of arms projecting from the central body in the direction of tubes of the frame tent assembly, the arms configured to wrap around and engage the tubes. The cover is installed and uninstalled each time the frame tent assembly is installed or uninstalled. The cover encapsulates hardware like pins and bails used with the fitting. The cover wraps a portion of the then pipes or poles with a partial sleeve.

The smooth-surface covering structure of the preferred embodiment is preferably using Kydex® thermo-formed material because Kydex® material is rugged, deformable, and can withstand forces such as those experienced by conventional frame tents. The Kydex® material is cut according to a template having a central body and a plurality of projections. The cover is initially heat pressed to spread over the tent fitting with a central body. The projections extend in various directions in order to track with any tent joint and the tubing or tent frame member components. The projections are heat pressed to establish an integral restraining structure as a mechanism by which the cover is secured to the tracked tent tubing or tent frame member. The heat pressing process also rounds the Kydex® material over the hardware of the fittings. Once the Kydex® material cools it retains the shape imparted by the tent frame, or a jig built to emulate the frame. One securing means for the cover is the friction fit caused by the interface between the pipes of the tent frame components and the underside of the heat-pressed Kydex® material. The cover desirably does not include external attachment means but is self-restraining due to the friction fit. The means of self-restraint must not include an edge or abrupt point of contact with the installed tent canopy but completes a smooth interface with the underside of the tent canopy. Alternative embodiments may permit compression clamping of the smooth-surface covering to the fitting body itself.

The cover of the present invention further comprises a number of embodiments, each configured to cooperate with a particular tent frame junction and component pairing. The primary embodiments will be configured to cooperate with standard ranges of tent configurations and sizes that are common in conventional tent frames, particularly those offered by Aztec Tents and the Qwik-top® line of tents. Covers can be mass-produced according to standard measurements of the typical range of tent sizes. In most cases, tent frames are predictably constructed of 2-inch aluminum, steel, titanium, or carbon fiber tubing and pins such as Acadapin pin assemblies. More specifically, and in a presently preferred embodiment, by way of example and not necessarily by way of limitation, the present invention cover is provided in arm configurations comprising multiples of three-arm, two styles of four-arm, a five-arm, several six-arm, and an eight-arm variation. However, a need for custom-cast configurations is recognized for less common tents or custom tents. Therefore, other substantial or slight variations will be necessary to conform to tent frame architecture. Many embodiments of the preferred cover will have a central line, on either side of which the cover has symmetry, or forms a mirror image of the other side.

The use of the cover of the present invention reduces man hours and labor at the site of installation for the frame tent. This is because the tent canopy, which normally comes in several smaller pieces assembled on the job site, can be preassembled in a warehouse, shop, or barn. The preassembly can be accomplished by two workmen in a shop in less time than it takes on the job site because the environment is less hazardous to the canopy. The canopy itself can be assembled and remain assembled at a certain size (e.g. 40×80) throughout the year. No assembly or disassembly of the canopy itself needs to take place on similar installs or take down. Instead of detaching and reattaching 5-20 foot sections of canopy (such as in a size of 40×100) on-site, one-piece that has already been joined together off-site is brought to the job install site. Then, only a smaller tarp or drop cloth is used to cover the initial 4' of the frame and the ground where the assembled canopy is unrolled immediately prior to installation. The main reason for this is to keep the canopy clean and off the ground though. Whereas, on-site assembly requires use of the entire crew, usually 6-8 guys, taking numerous precautions as they try to protect the canopy from the ground, wind, precipitation, and other outdoor elements off-site preassembly can save the larger crew hours on the individual job sites. Use of the present invention cover permits installation crews to move from job to job in a more efficient fashion. In addition to saving time on one job, the saved time increases opportunities for more installations in a single day, which is a significant business advantage for tent installation companies that do the majority of their business in the wedding season and summer months. Importantly, the canopy preassembly benefit also reduces the canopy exposure to wind and moisture as well as potential contact with the ground. On the job site, the canopy is laid out on one smaller drop cloth and pulled over the top assembly of the tent in one fluid action.

The cover of the present invention guards the edges of the tubing and fitting and also the hardware during installation, use, or take-down. Therefore, the cover protects the canopy from scrapes and abrasions it might sustain from the sharp edges of the tent frame or the interface between the joint fitting and the tent tubing.

As can be appreciated from FIG. 19, the pins can wear holes in a tent canopy stretched or tensioned tightly over them. The cover of the present invention shields the pins and protects the canopy from poking or abrasion caused by the pins, pin bails, or similar hardware.

The cover of the present invention also inhibits the transfer of oxidation to the canopy fabric. The cover further protects the canopy from any dirt, rust, or chemicals that might be around the surface of the junction. Therefore, the use of the cover prevents staining and damage to the fabric membrane of the canopy.

In addition to protecting the canopy from contact with the hardware, the cover of the present invention also provides some protection to the tent hardware itself, by limiting the hardware's exposure to excess dirt and weather elements. The physical covering of the tent frame may inhibit rust of components or oxidation of the hardware.

Tests of the present invention have been successful. In one installation, a frame tent was installed for the winter over a pool construction project at a mountain ski resort. The tent installation included the covers of the present invention. First, upon installation, the tent canopy did not come into contact with any pins or abrasive tent frame pipe edges. Second, over the course of a very harsh winter, the tent canopy did not experience any holes or uneven wear at the tent junction points. Upon removal from the tent installation, the canopy looked like new and was immediately reusable at the next site without excess cleaning or any repairs. The multiple covers of the present invention were removed and successfully reused on the next tent installation.

The present invention is easy to install and use of the appropriate embodiment of the device is immediately apparent upon viewing the junction of the tent in question. No tools are needed to install the cover. Once the cover embodiment with the appropriate number of arms is located, the pin bails are oriented and synchronized, the arms are aligned with the tent frame and the arms are pressed over tent frame components one by one until the installation slit of the compression sleeve opens and receives the tent tube, clamping the entire cover in place on the tent joint. Once each arm has received the tent frame components at the joint, the cover device is self-restraining with a friction fit so no hardware is used to hold the cover in place. To uninstall the cover, the user pulls up on one arm at a time until the tent tubing once again traverses the installation slit to exit the compression sleeve.

The cover is strong, lightweight, low cost, and may be scaled to almost any desired size with any number of arms to adjoin a tent frame component junction.

The cover encloses different frame configurations in a lightweight, strong, durable, and scalable manner without impacting the portability or functionality of the tent.

The use of the cover with tent assemblies will permit longer-lasting canopies and reduce cleaning tasks for installers and users of frame tents. Because the cover is also enclosing the hardware and edges of the tent frame components it will also extend the useful life of those components.

The foregoing has outlined, in general, the physical aspects of the invention and is to serve as an aid to better understanding the more complete detailed description that is to follow. In reference to such, there is to be a clear understanding that the present invention is not limited to the method or detail of construction, fabrication, material, or application of use described and illustrated herein. Any other variation of fabrication, use, or application should be considered apparent as an alternative embodiment of the present invention.

BRIEF DESCRIPTION OF THE DRAWINGS

The following drawings further describe by illustration, the advantages and objects of the present invention. Each drawing is referenced by corresponding figure reference characters within the "DETAILED DESCRIPTION OF THE INVENTION" section to follow.

DETAILED DESCRIPTION OF THE INVENTION

Figure 1:
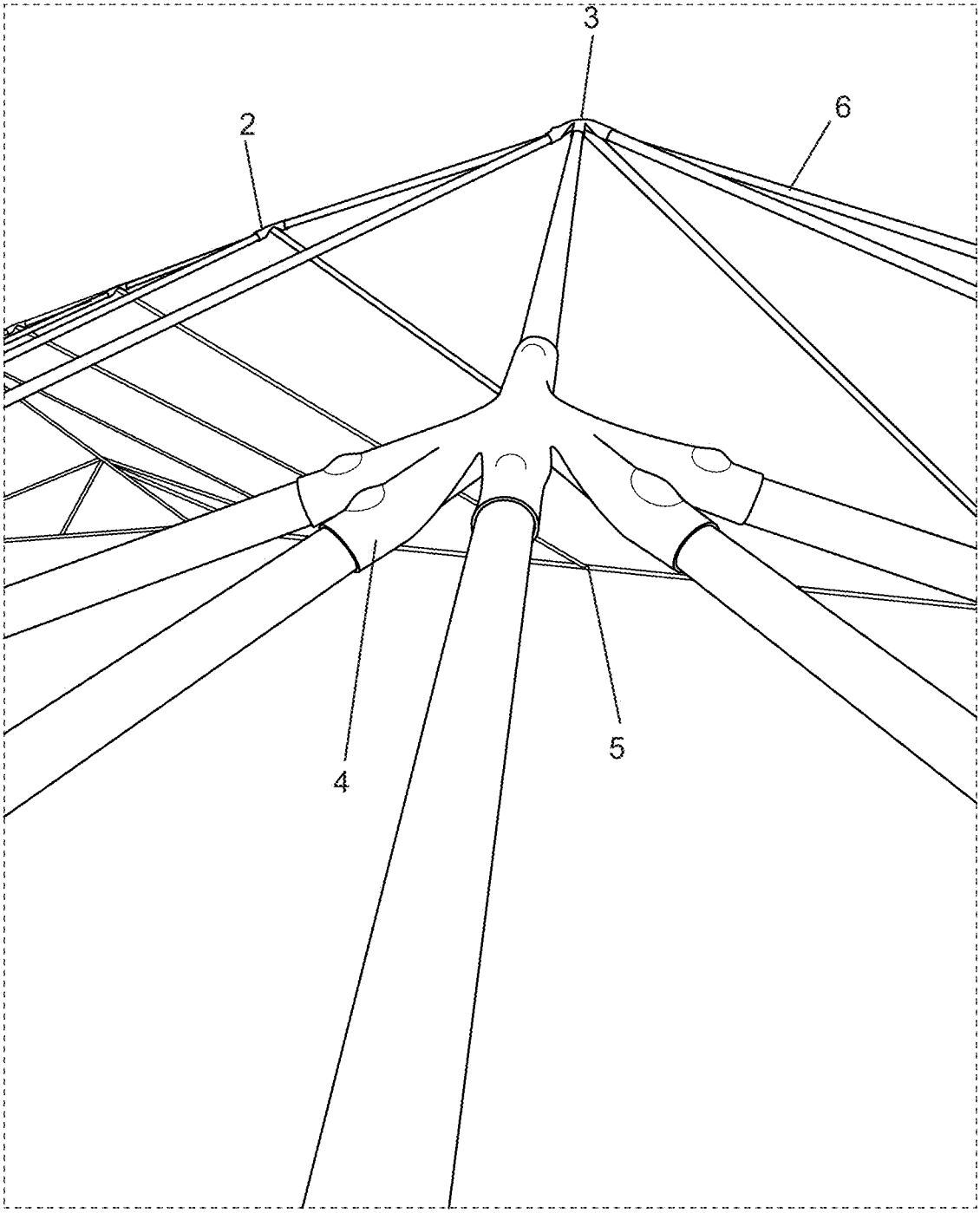
FIG. 1 is a perspective view of the present invention installed for use on the tent canopy frame assembly.
Figure 19:
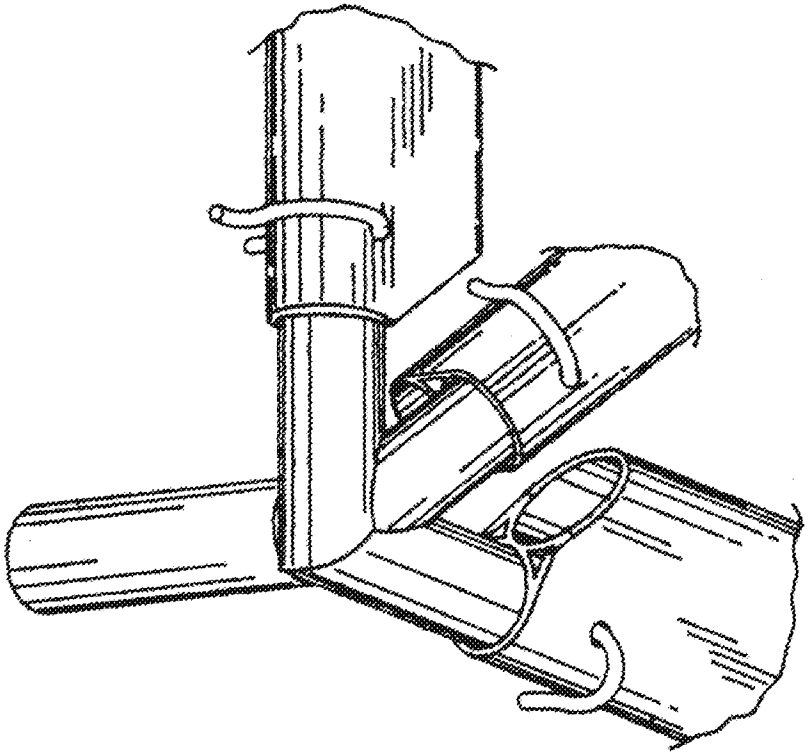
FIG. 19 is a side perspective of a prior art, conventional tent frame junction before a canopy is added as shown in the prior art and particularly depicting the tent frame body portions, the tent frame junction fitting, and pins joining the tent frame and the fitting.

Several embodiments of the cover structure of the present invention are demonstrated as installed on the frame of a conventional tent in FIG. 1. A single tent structure may require many covers since various tent frame structures intersect in various manners at joints and junctions around the tent frame. In addition to being available in various, selectable arm configurations, the present invention is strong, lightweight, low cost, and may be scaled to almost any desired size. As illustrated in FIG. 1, at least one cover is adapted for attaching to adjoining pieces of a tent and at least one piece of hardware such as those depicted in FIG. 19. The application of the cover adds a smooth upper surface to interface with a tent canopy and protect it from items such as those shown in FIG. 19.

Figure 2:
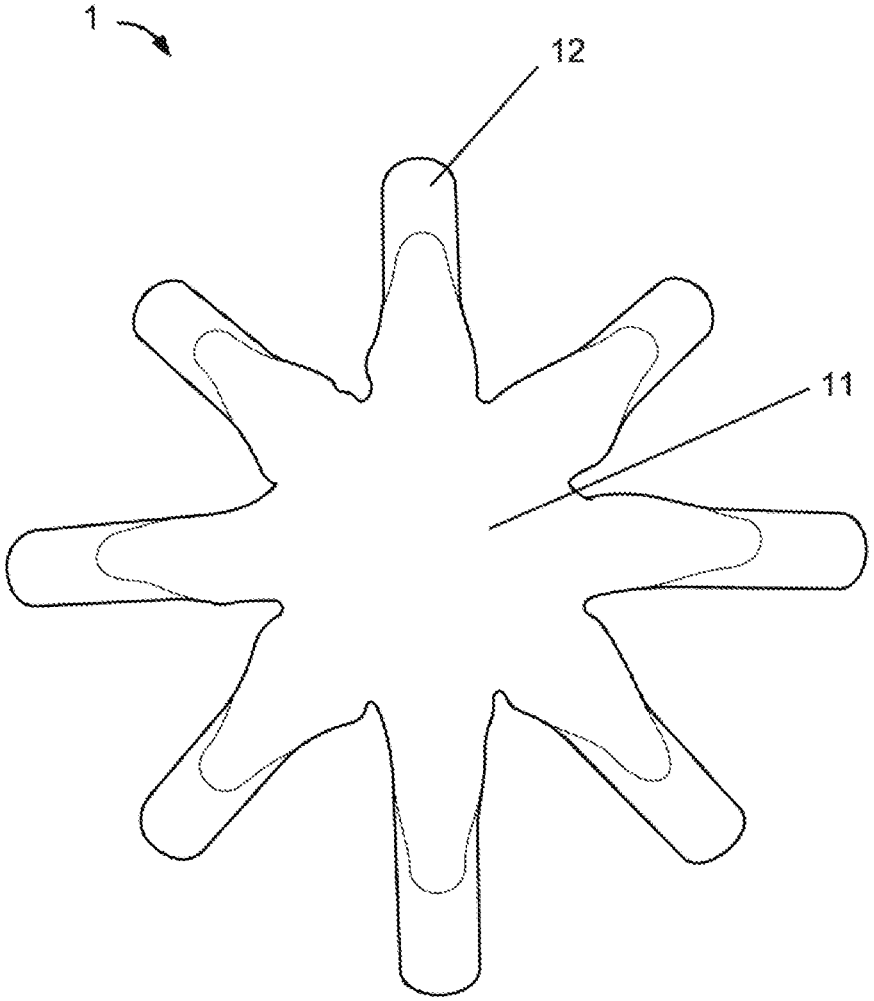
FIG. 2 is a top elevation view of an embodiment of the present invention having an eight-way connection.
Figure 3:
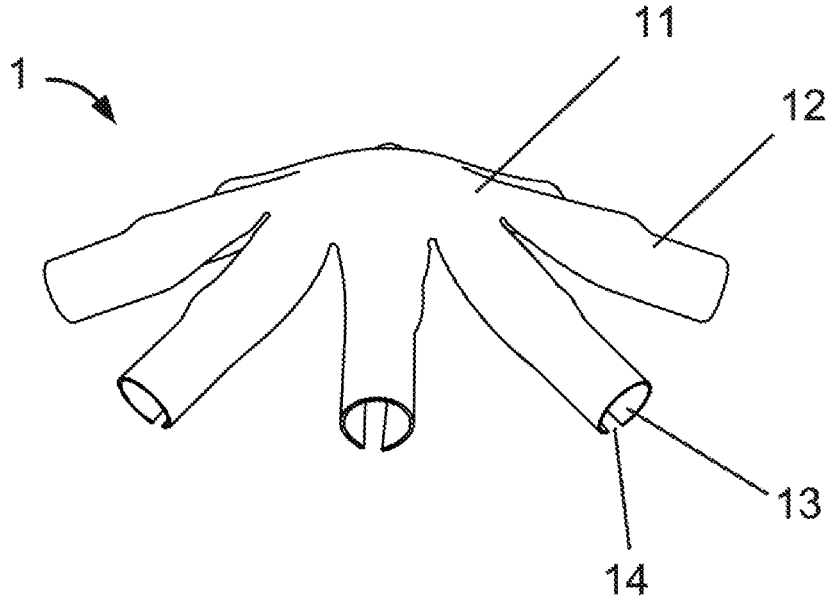
FIG. 3 is a front perspective view of the embodiment shown in FIG. 2.
Figure 4:
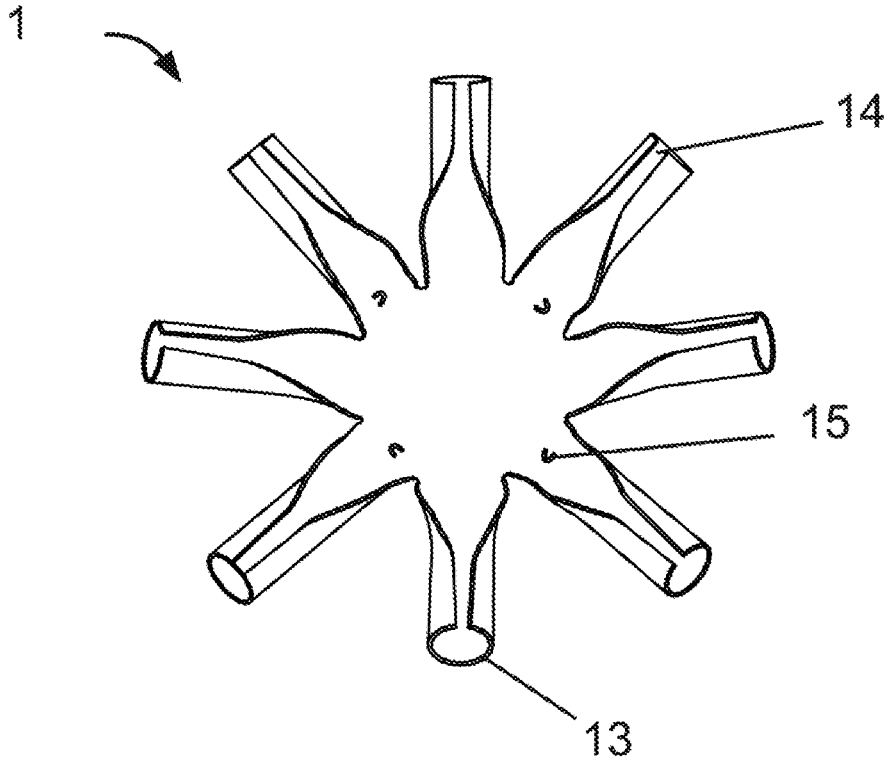
FIG. 4 is a bottom perspective view of the embodiment shown in FIG. 2.

With reference to FIGS. 2-4, an eight-arm cover 1 embodiment is illustrated. The cover comprises a centralized body 11 with arms 12 reaching, in this case, in eight directions. The eight arms 12 wrap and terminate in a compression fit tube 13 having an installation slit 14 through which the tent frame components 6 pass in order to enter the opening to the compression fit tube 13. For proper installation, the tent frame hardware such as the pins must align with the various pin cavities 15 formed in the cover 1.

Figure 5:
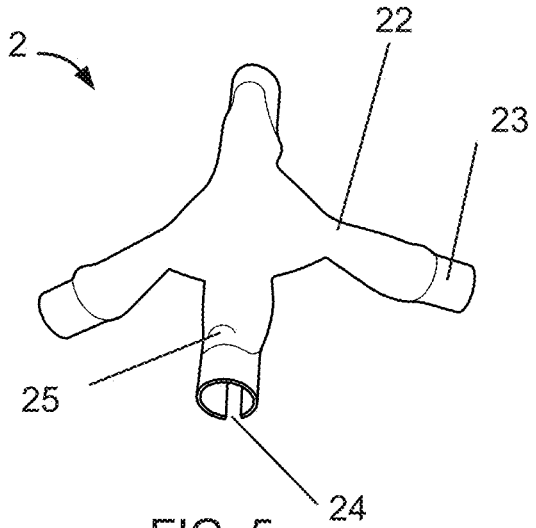
FIG. 5 is a top perspective view of another embodiment according to the present invention having a four-way connection.
Figure 6:
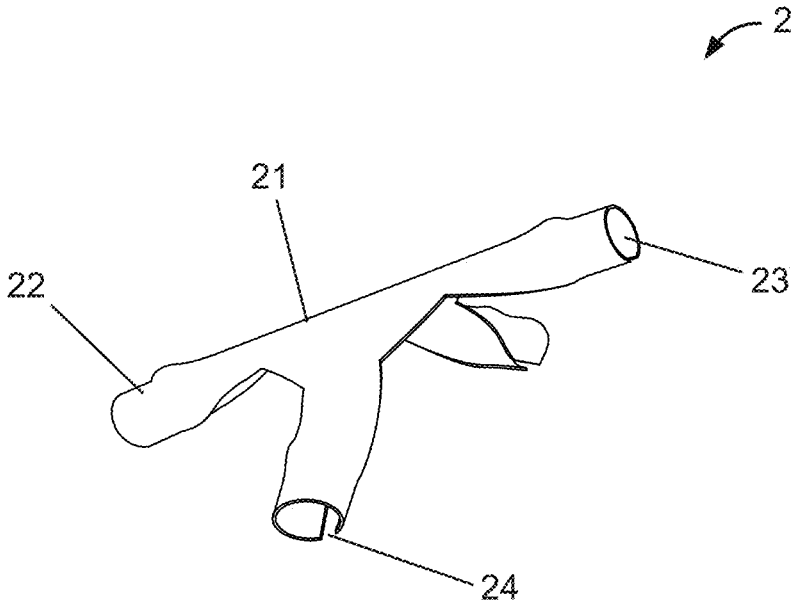
FIG. 6 is a side perspective view of the embodiment shown in FIG. 5.
Figure 7:
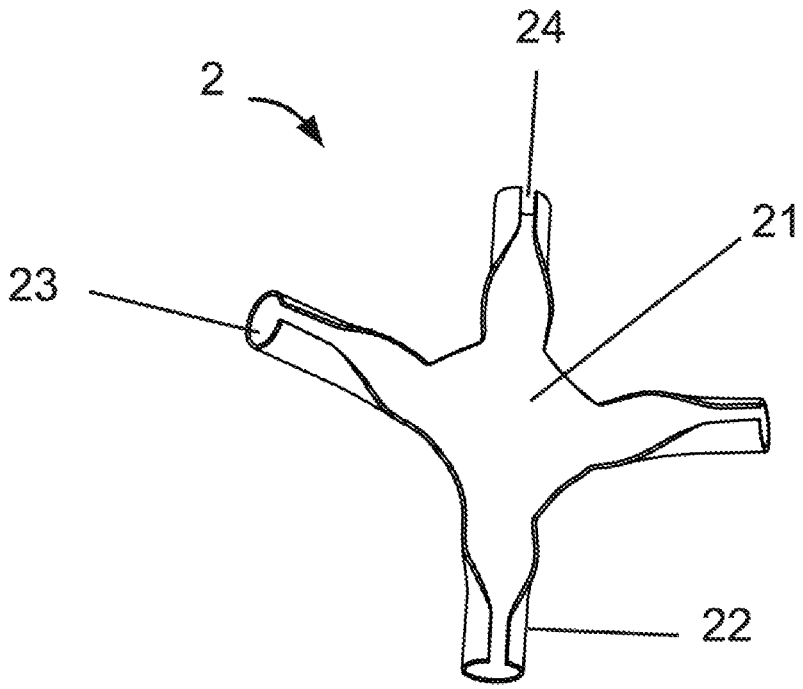
FIG. 7 is a bottom perspective view of the embodiment shown in FIG. 5.
Figure 8:
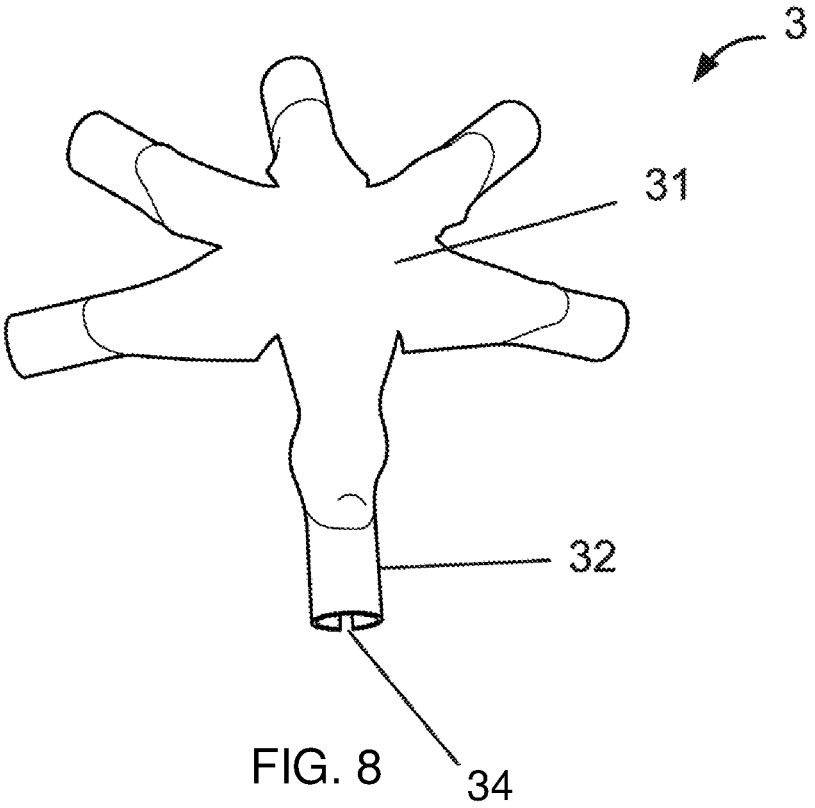
FIG. 8 is a top perspective view of another embodiment according to the present invention having a six-way connection for use at the ridge.
Figure 9:
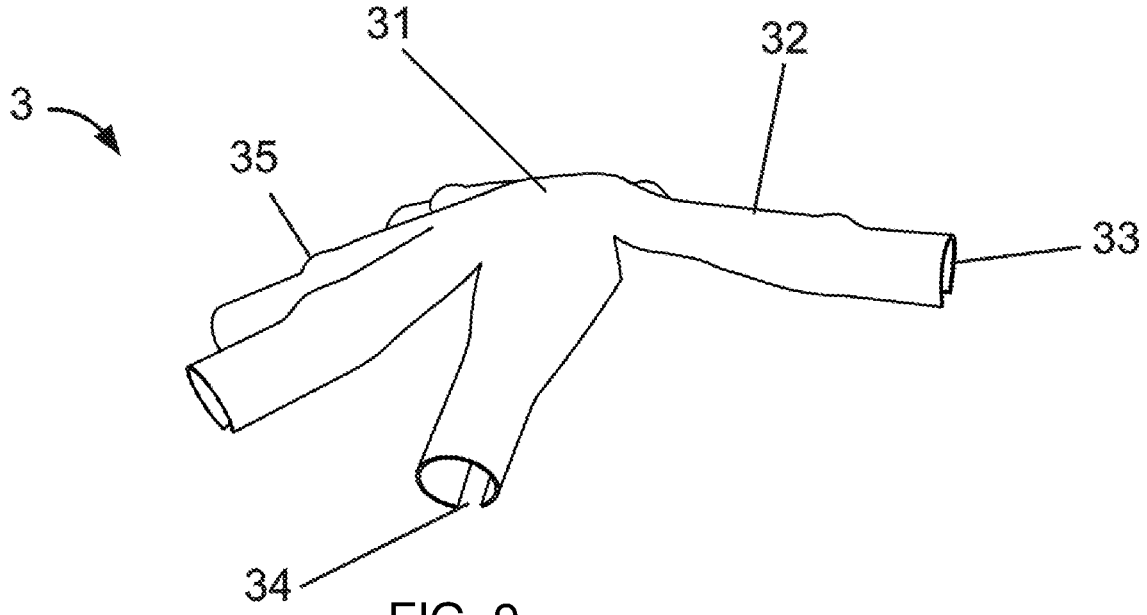
FIG. 9 is a front perspective view of the embodiment shown in FIG. 8.
Figure 10:
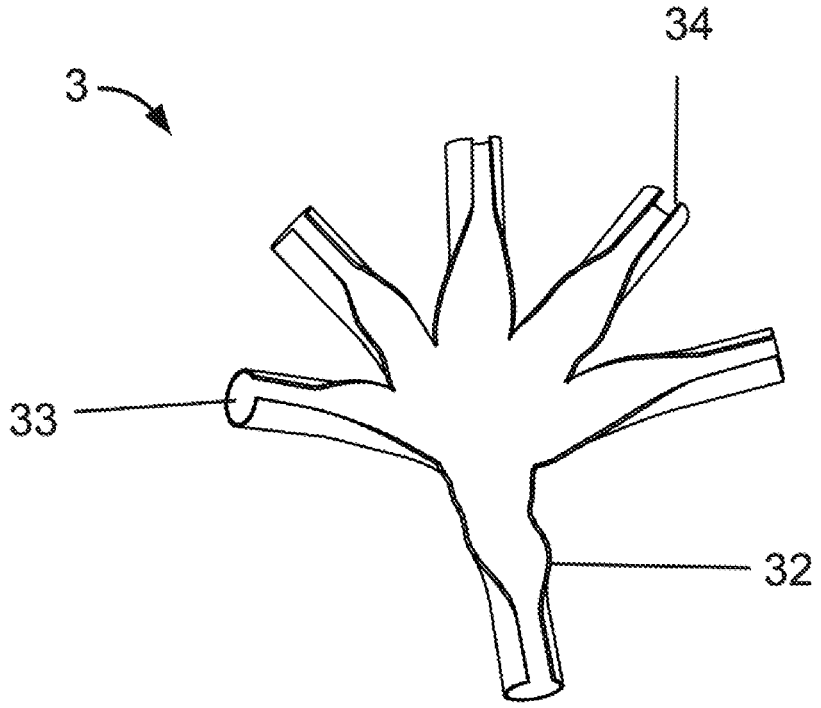
FIG. 10 is a bottom perspective view of the embodiment shown in FIG. 8.
Figure 11:
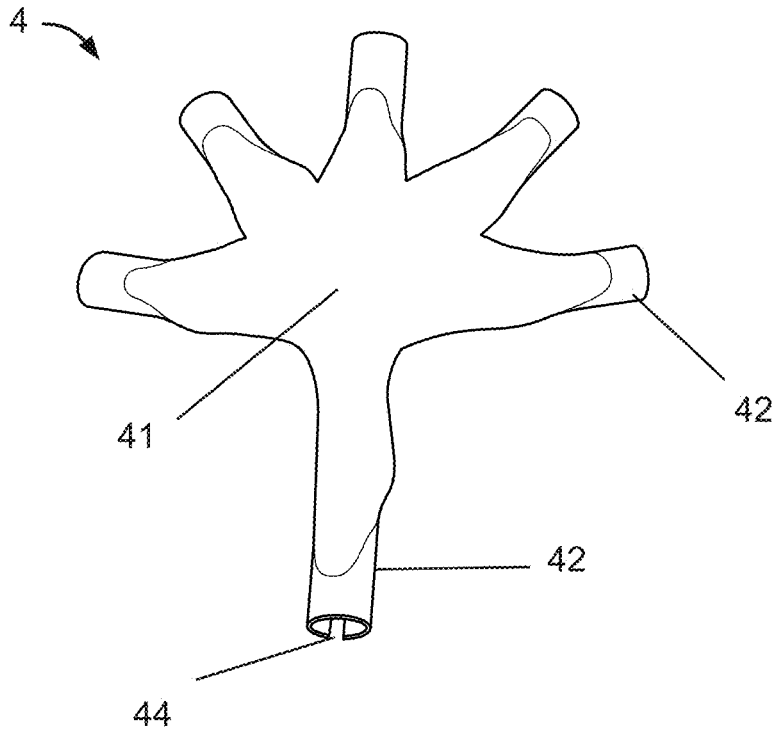
FIG. 11 is a top perspective view of another embodiment according to the present invention having a six-way connection for use at a hip.
Figure 12:
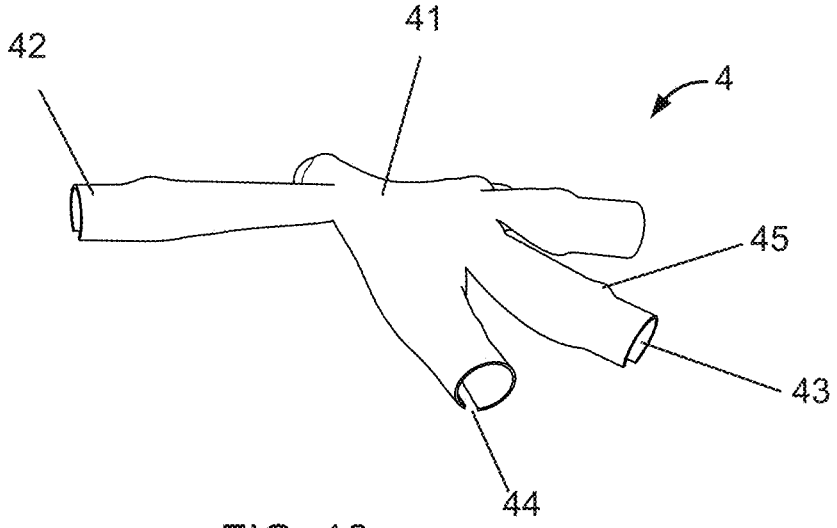
FIG. 12 is a front perspective view of the embodiment shown in FIG. 11.
Figure 13:
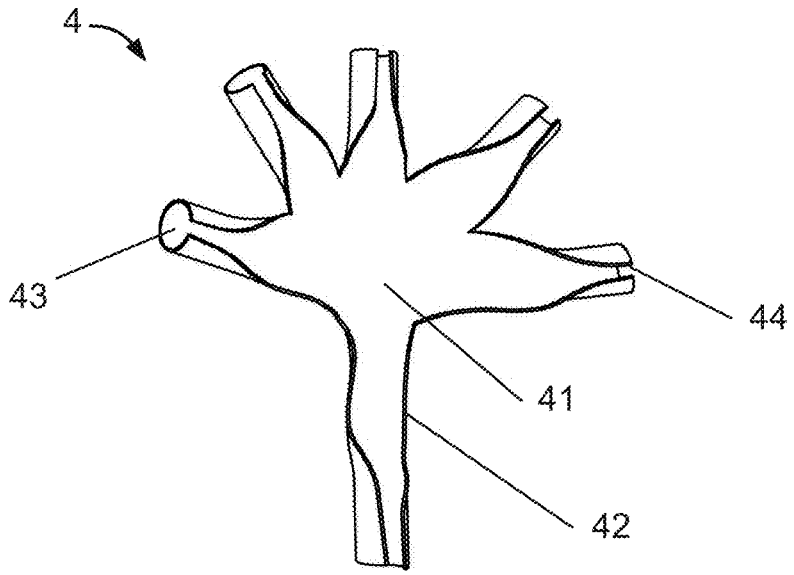
FIG. 13 is a bottom perspective view of the embodiment shown in FIG. 11.

Turning to FIGS. 5-7, a four-arm cover 2 embodiment is illustrated. The cover comprises a centralized body 21 with arms 22 reaching, in this case, in four directions. The four arms 22 wrap and terminate in a compression fit tube 23 having an installation slit 24 through which the tent frame components 6 pass in order to enter the opening to the compression fit tube 23. For proper installation, the tent frame hardware such as the pins must align with the various pin cavities 25 formed in the cover 2.

In FIGS. 8-13, two six-arm cover 3, 4 embodiments are illustrated. The cover comprises a centralized body 31, 41 with arms 32, 42 reaching, in this case, in six directions. The six arms 32, 42 wrap and terminate in a compression fit tube 33, 43 having an installation slit 34, 44 through which the tent frame components 6 pass in order to enter the opening to the compression fit tube 33, 43. For proper installation, the tent frame hardware such as the pins must align with the various pin cavities 35, 45 formed in the cover 3, 4. The first, six-arm cover 3 embodiment in FIGS. 8-10 differs significantly in its shape when compared with the second, six-arm cover 4 embodiment shown in FIGS. 11-13. The cover embodiment shown in FIGS. 8-10 has five arms that slope downward to match the angle at which the rafter beams and hip rafter beams connect to the ridge. Meanwhile, for the cover embodiment in FIGS. 11-13 the center arms form straight line to receive the hip rafter beams while the other four arms will slope downward slightly to receive the hip beam supports. The first, six-arm cover 3 embodiment is used at the crown or the end of the ridge of a rectangular tent while the second, six-arm cover 4 embodiment is used at the junction of multiple hip beams with multiple ridge spans. The first, six-arm cover 3 embodiment is depicted at the crown of FIG. 1, while the second, six-arm cover 4 embodiment is depicted in FIG. 1.

Figure 14:
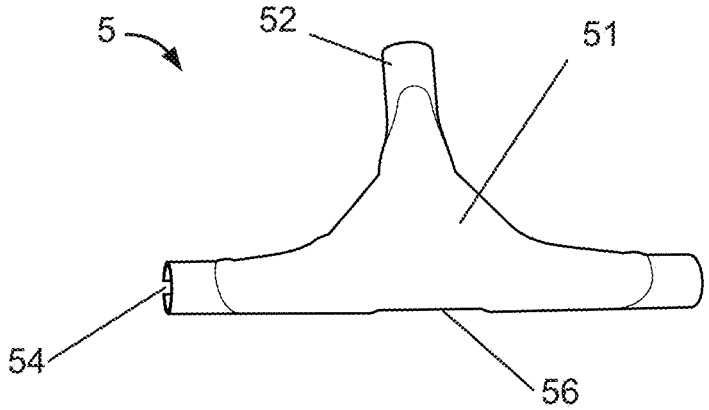
FIG. 14 is a top perspective view of another embodiment according to the present invention having a three-way connection.
Figure 15:
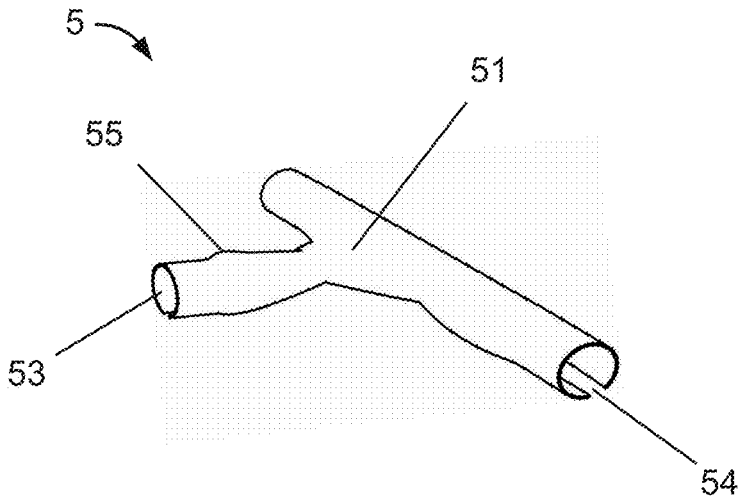
FIG. 15 is a side perspective view of the embodiment shown in FIG. 14.
Figure 16:
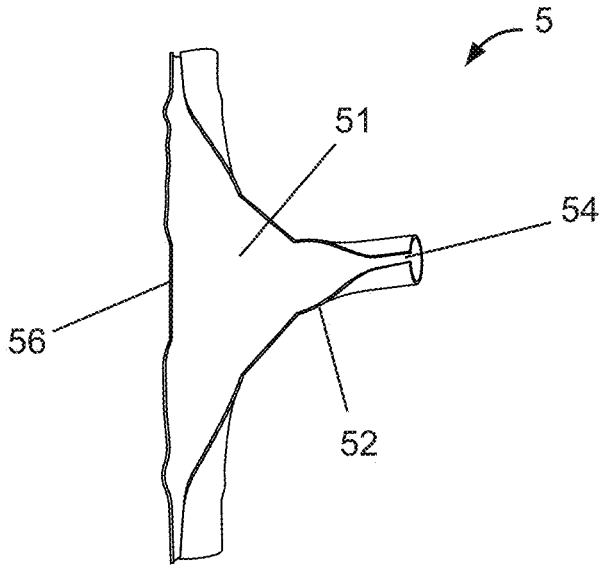
FIG. 16 is a bottom perspective view of the embodiment shown in FIG. 14.

FIGS. 14-16 depict a three-arm cover 5 embodiment. The centralized body 51 has three arms 52 extending in three directions, two of the arms may occur in the same plane as they are intended to join two spans of the wall beams and a rafter beam (see FIG. 1). The Qwik-top® product manual calls out this junction and designates the use of a tee fitting. The cover comprises a centralized body 51 with arms 52 reaching, in this case, in three directions. The three arms 52 wrap and terminate in a compression fit tube 53 having an installation slit 54 through which the tent frame components 6 pass in order to enter the opening to the compression fit tube 53. For proper installation, the tent frame hardware such as the pins must align with the various pin cavities 55 formed in the cover 5. In this embodiment, a leg cutout 56 is provided as a convenient adaptation to abut the leg, which extends downward from the covered joint. In the case of larger tents, a special tee junction may be required. In that case, a cover similar to the three-way cover in FIGS. 14-16 would be configured to add two additional arms. The five-arm cover embodiment is not shown but would serve to adjoin with the special tee fitting as could a six-arm cover embodiment.

Figure 17:
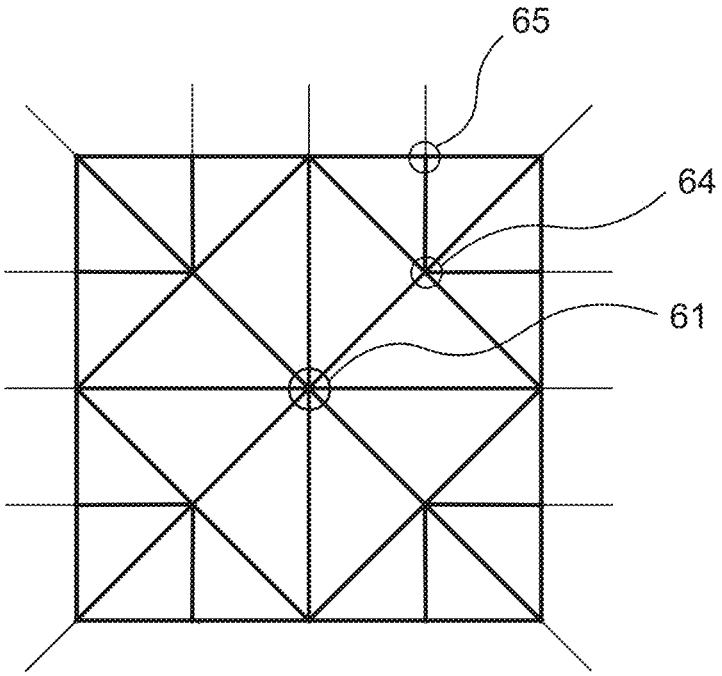
FIG. 17 is a schematic plan view of a conventional square frame tent with locational depictions of the present invention applied at various tent frame junctions.
Figure 18:
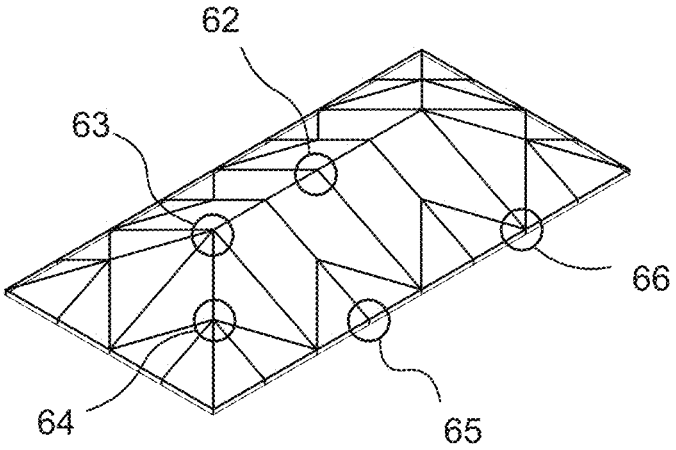
FIG. 18 is a schematic isometric view of a conventional rectangular frame tent with locational depictions of the present invention applied at various tent frame junctions.

The schematic tent illustrations in FIGS. 17-18 help explain how various embodiments of the present invention cover can be used at one time on a single, framed tent. Depending on the tent, covers may be needed for fittings including but not limited to: corner, ridge intermediate, hip intermediate, three-way crown, four-way crown, six-way crown, and eight-way crown fittings. FIG. 17 illustrates a square tent. The tent in this illustration requires a three-arm cover 5 at location 65 where the perimeter joins the rafter beam support. The square tent in FIG. 17 utilizes the second, six-arm cover 4 embodiment at the intermediate hip location 64 and finally, the eight-arm cover 1 is installed at location 61, the crown of the tent. Turning to FIG. 18, a rectangular frame tent is depicted. This tent also uses the second, six-arm cover 4 embodiment, again denoted with location 64 at the hip fitting and a three-arm cover 5 at location 65 where the perimeter joins a rafter beam. The tent in FIG. 18 also requires the use of a four-arm cover 2 at location 62 where the ridge joins with two rafter beams. Finally, the tent in FIG. 18 also requires the use of a six-arm cover 3 at location 63 where the ridge connects with the hip rafter beams and rafter beams. Optionally, the tent in FIG. 18 could use an alternative five-arm or six-arm cover at location 66 if additional supports were included off of the rafter beams. Thus, according to the schematic drawing, the rectangular tent depicted would require the use of at least five but possibly more of the covers according to the present invention. While the installation of the many various covers in each location will require a bit of installation time, that installation time will be far outweighed by the amount of time saved by the installers in permitting the preassembly of the tent canopy and the avoidance of a great deal of wear and tear on the canopy if on-site assembly and disassembly had been necessary. After the covers are installed as depicted in FIGS. 17-18, the entire canopy is pulled over the top assembly and secured in place in a single step. The covers can be removed quickly during tent disassembly simply by grasping by hand one arm of the cover and pulling up until the partially open compression fit tube expands and releases the frame piece 6 through the installation slit.

The cover may be configured to cover any or none of the following fitting junctions:

central crown fitting (eight-way, six-way, four-way, three-way)

end crown fittings (six-way) and specialized end crown fittings (eight-way)

corner fittings double-hip eave fittings mid-crown fitting (four-way)

end eave fittings side eave fittings hip eave fitting (five-way)

ridge intermediate, or intermediate.

Particularly advantageous covers include the eight-way, three different six-way covers, two different styles of four-way covers and multiple styles of three-way covers. The cover was designed to be compatible with Qwik-top® style tents from Aztec, however, the covers also fit Aztec's traditional style frame tents. The cover will also specifically fit many other manufacturers' 2" frame tents, such as American Tent, Central Tent, Fred's Tents & Canopies, and other manufacturers who have 2" frame tents. The covers are easily modified to fit less common tent configurations or custom tents.

Each cover comprises a central body and arms to track the tent frame pieces, the central body and arms further comprise hardware-receiving indentations to enclose and protect the tent canopy from the harsh edges and materials of the hardware. The number of arms vary depending on the fitting sought to be covered. The number of hardware receiving structures vary depending on the types of tent frame and necessary relative hardware. Beyond the examples illustrated, the minimum cover embodiment comprises structures and features to enclose at least two pin and at least two frame pieces as well as the tent fitting adjoining those frame pieces. The minimum cover embodiment will be used infrequently as most tent junctions require the joining of at least three of any of a tent pole, leg, or beam. A second cover embodiment includes structures and features to enclose at least two pins and at least three frame pieces as well as the tent fitting adjoining those frame pieces. A third cover embodiment includes structures and features to enclose at least three pins and at least four frame pieces as well as the tent fitting adjoining those frame pieces. A fourth cover embodiment includes structures and features to enclose at least four pins and at least five frame pieces as well as the tent fitting adjoining those frame pieces. A fifth cover embodiment includes structures and features to enclose at least five pins and at least six frame pieces as well as the tent fitting adjoining those frame pieces. A sixth cover embodiment includes structures and features to enclose at least six pins and at least seven frame pieces as well as the tent fitting adjoining those frame pieces. A seventh cover embodiment includes structures and features to enclose at least seven pins and at least eight frame pieces as well as the tent fitting adjoining those frame pieces. An eighth cover embodiment includes structures and features to enclose at least eight pins and at least seven frame pieces as well as the tent fitting adjoining those frame pieces. A ninth cover embodiment includes structures and features to enclose at least nine pins and at least ten frame pieces as well as the tent fitting adjoining those frame pieces. It is unlikely a tent frame junction would require more than ten components meeting and requiring the use of the present cover.

When constructed of the preferred materials, such as Kydex® material, a plastic/poly alloy, resilient plastic, polycarbonate, acrylic, or PVC, each arm is substantially tube-shaped and hollow and is meant to snap onto the tent frame members. Each arm will include a slot running the length of the under arm, which, due to the nature of the deformable material, can expand to receive the frame and then compress or snap back so that the arm is secured in place to enclose the tent frame features. The relative strength of the cover to remain in place occurs in part due to the cooperative nature of the arms wrapping around each relative frame member. In other terms, the cover forms a sheath over the joint fitting and also includes arms with deformable engageable recesses to attach the cover to the tent frame. Surface shape adaptations are made in the sheath to create cavities to receive the tent connecting pins. The snap-insertion of the tent frame tubing into the deformable arms results in a friction fit to hold the cover onto the tent frame. Once each cover is installed at the tent joints or junctions, the canopy can be pulled over the tent roof assembly.

The present invention provides a simple, low-cost, lightweight, strong, and durable joint cover for rapidly assembling, reconfiguring, or disassembling a tent canopy from a tent frame structure. The present invention joins and secures tubular members around the frame members using a cover that requires minimal manufacturing costs as it is constructed with common, off-the-shelf materials and components.

The present invention includes a joint cover that may be easily scaled using any size and number of frame members, and could be easily adapted to use with any type of structure with a malleable cover and semi-rigid frame structure including frame tents, geodesic domes, trusses, yurts, slabs, 4-sided pyramids, 5-sided pyramids, and circular structures.

The device can be made of any material such as flexible vinyl or acrylic alloy with sufficient strength and flexibility to wrap around the fitting, hardware, and poles of the tent while laying out a smooth surface over which the canopy can extend. Early versions of this invention were two-dimensional and required multiple, individual covering structures being attached to the tent frame by external attachment mechanisms like zip ties, snap hardware, and elastic rubber bands. While the use of these mechanisms met some of the objectives of the present invention, they were not durable, and the use of excess attachment mechanisms added points of weakness and added time-consuming steps to attach the two-dimensional soft covers. The attachment mechanisms themselves also proved to contact the tent canopy in a way that could lead to abrasions over time.

The preferred embodiment of the present invention requires the use of highly durable thermoplastic alloy, such as Kydex® brand material ("Kydex® material"). The Kydex® material or similar materials are available in sheets from various commercial outlets. Kydex® material is an extremely durable, acrylic/PVC (polyvinyl chloride) alloy that offers excellent durability, resilience, chemical resistance, dimensional stability (e.g., low water absorption, relatively low coefficient of expansion), and flameretardancy. It withstands impact, scratching, gouging and general abuse. It does not crack, break, chip, or shatter and is available in a range of thicknesses (e.g., from 0.028" to 0.250"). However, it is bendable. The outstanding formability of Kydex® material sheeting enables it to conform fully to the material over which it is cast. Once thermo-formed, it will smoothly lay over or absorb curves, sharp edges and high spots on the tent frame. It has the unique ability to retain uniform wall thickness on high spots, low spots, and sharp corners where other sheet products may "thin out." Once thermo-formed it has memory and retains or returns to its shape after manipulation, expansion, or deformation. The material is UV resistant and has low thermal expansion. The nature of the Kydex® material permits a color palate selection that will blend with any tent canopy or pole color scheme. Most large tents are white and the preferred Kydex® material combination results in a white device that does not attract attention or interfere with the aesthetics of a white tent.

The Kydex® material is cut according to a template having a central body and a plurality of projections. The cut can be based on a template made by hand, or preferably by a CNC machine. The cover is initially heat pressed to spread over the pre-selected tent fitting when combined with the tent tubing and pins, which are intentionally larger than the pins that will actually be used in the tent installation. As an alternative to using the actual tent fitting and tubing, a jig may be constructed for repeated use during the thermoforming process. The template projections extend in various directions in order to track with any tent joint and the tubing or tent frame member components. During initial manufacturing, the projections are heat pressed over the tent tubing and folded around the two-inch pipe to establish a partially open compression fit tube for every arm of the cover. The compression fit arm creates an integral restraining mechanism as a means by which to secure the cover structure to tubing of the tent frame. The heat pressing process also allows customization for other tent components. For example, the Kydex® material rounds over the hardware of the fittings without creating a thin area in the cover. The result is that the cover snaps into place on the tent frame and is held by a friction fit caused by the interface between the exterior walls of the tent frame components and the interior walls of the thermo-formed Kydex® material. The cover desirably does not include external attachment means but is self-restraining due to the friction fit. The means of self-restraint must not include an edge or abrupt point of contact with the installed tent canopy. Alternative, embodiments may permit compression clamping of the smooth-surface covering to the fitting body itself or creating multiple pieces of the cover that snap together in a seamless or nearly seamless manner.

The cover of the present invention is configured to extend over a portion of a tent pole as well as the fittings and junctions or seams therebetween. The cover necessary comprises notches giving the outward appearance of knuckles in the cover. Each notch forms a pin cavity, which allows space for the pins or hardware to be installed under and protected by the cover. In the preferred embodiment, during the thermo-formation process, each pin basket is oriented in the same direction, such as toward the interior of the tent joint. When the cover is later installed on the tent, it is necessary for the pin baskets to once again be oriented in the same direction. This results in a snug and correct fit so that the cover engages the tent frame and will not move once installed. The cover will easily snap into place over the pins and be held in place by the self-restraining means for securing the cover in a wrapped formation around the tent frame components.

Instead of being formed out of an initial flat sheet of material, it may be advantageous or desirable to originally manufacture the cover of the present invention using alternative construction methods such as by 3D printing or another manufacturing system. The objectives of the present invention may be met using any material that can be configured or manipulated to create a cover formed to have the necessary shape to receive and hold fast to the fittings and neighboring hardware, pipes, or poles. Additionally, adaptations of the device could be manufactured as a permanent addition to the frame fittings or accessory to the pole tops. Additionally, the cover could be used to conform as an attachment connected to other tent accessories. If the initial material used to construct the material has an undesirable color, the cover could be painted or otherwise dyed to match or contrast with the color of the tent frame or tent canopy.

Although the cover has been used with tents having 2-inch pipes and poles, the cover can easily be adapted to different pole sizes and shapes. For example, it could work with round, triangular, square, or other cross-sectional pole shapes.

Tent roof installation using the present cover allows for easier installation and significant reduction in wear to the roof fabric due to repetitive installations. The cover alters the contact surface for the underside of the tent canopy and therefore acts as a buffer for the tent material from harsh and sharp surfaces of metal pipes, metal fittings, brackets, and pins. The device wraps the hard surfaces and provides a soft-sided contact point for the canopy. The gentle curvature allows the tent canopy to withstand repeated installations, endure harsh weather events, and weather long exposure to the elements.

The installation of a tent using the present invention comprises the steps of: Combining or preassembling the individual canopy pieces, if present, in a clean dry location such as a shop and packing the combined canopy for transport; Traveling to the tent installation location with the tent components and the present invention; Installing the top assembly tent frame components as instructed by the manufacturer except as the tent top assembly is joined together, one or more covers of the present invention are installed at one more joints of the tent; Installation of the cover is accomplished by observing the joint and locating the coordinating cover having the correct number of arms to adjoin the junction and aligning the cover arms with the junction and snapping the arms over the tent frame components. The step of snapping the cover over the tent frame so that the cover clasps the tent arms is intended to be performed by hand; Applying a ground cover cloth at the foot of the tent to receive the preassembled canopy; Pulling the canopy over the tent frame and attaching it as instructed by the manufacturer; Installing the additional frame and securing components of the tent as instructed by the manufacturer.

To uninstall a tent, the process above is reversed, with the exception that instead of snapping the arms onto the tent frame, each cover is removed by disengaging the arms from around the tent frame one by one until the entire cover releases. The step of separating the first and second or more arm members from the tent frame components will be done by hand.

A significant advantage of the present invention is that it creates a smooth overlay of the tent frame joints and permits preassembly of the canopy offsite. Once on site, the canopy can be pulled over the frame with the covers in one fluid action and there is no need to assemble the canopy in pieces over the top assembly while on the job site. Depending on the next intended use, the canopy can remain assembled between jobs.

The preferred embodiment for the cover will be approximately 6 inches high, 22 inches long, and 22 inches wide. Slight variations will be necessary depending on the point of application and tent components involved. It is necessary that the cover have a minimal thickness in order to maintain a low profile when installed on the tent frame. Excess thickness may create wear points in the tent canopy. In preferred embodiments, the cover thickness will taper at each terminal end of the arm projections. A smooth transition between the cover and the tubing will enhance the objectives of the present invention. The currently use Kydex® material thickness is 0.08 inches, but thinner is preferred.

It is understood that when an element is referred to as being "around", "over", or "on" another element, it can be directly on the other element or intervening elements may also be present. Furthermore, relative terms such as "inner", "outer", "upper", "above", "lower", "beneath", "below", and similar terms, may be used herein to describe a relationship of one element to another. Terms such as "higher", "lower", "wider", "narrower", and similar terms, may be used herein to describe angular relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention. Further, the term "original" is often used to describe devices that were part of a frame tent system before the tent included a cover, although this should not be interpreted as the only meaning of the term.

Embodiments of the invention are described herein with reference to view illustrations that are schematic illustrations. As such, the actual thickness of elements can be different, and variations from the shapes of the illustrations as a result, for example, of manufacturing techniques, configurations, and/or sizes are expected. Thus, the elements illustrated in the figures are schematic in nature and their shapes are not intended to illustrate the precise shape of a region and are not intended to limit the scope of the invention.

Embodiments of the present invention can comprise types to fit many various fitting designs such as those occurring at one or more rafter beams, side eave fittings, mid crown fittings, end crown fittings, and/or other fittings described or consistent with those discussed herein. In a preferred embodiment, the covers of the present invention are supplied with the original purchase of the framed tent with the canopy. However, after-market covers may be used to retrofit various tent fittings. All or some of the attachment systems used to connect the tent can be original attachment systems, meaning the after-market cover should connect to corresponding parts in an original frame tent.

Although the present invention has been described in detail with reference to certain preferred configurations thereof, other versions are possible. Therefore, the spirit and scope of the invention should not be limited to the versions described above.

While the invention has been described with respect to particular embodiments shown and discussed above, numerous alternatives, modifications, and variations will occur to those who read and understand this specification. It is intended that all such alternatives, modifications, and variations be included within the spirit and scope of the claims that follow.

It is further intended that any other embodiments of the present invention that result from any changes in application or method of use or operation, method of manufacture, shape, size, or material, which are not specified within the detailed written description or illustrations contained herein, yet are considered apparent or obvious to one skilled in the art, are within the scope of the present invention.

I claim:

1. A protective cover for a frame tent assembly to support a tent canopy, the frame tent assembly comprising a plurality of tubes and at least one frame fitting junction, the frame fitting junction comprising a plurality of tent joint fittings, the plurality of tent joint fittings configured to removably receive the plurality of tubes, the protective covering comprising:

a centralized body;

a plurality of arms, at least one of the plurality of arms projecting from the centralized body in a direction of one of the plurality of tent joint fittings of the frame tent assembly;

at least one of a plurality of arms comprising an integral restraining structure;

the integral restraining structure comprising at least one partially open compression fit tube;

the protective cover sized to overlay one of the at least one frame fitting junction; and the protective cover being self-restraining over the one of the at least one frame fitting junction.

2. The protective cover of claim 1, further comprising:

a smooth upper surface to interface with the tent canopy and an underside to engage the frame tent assembly.

3. The protective cover of claim 1, wherein the protective cover comprising thermoplastic material.

4. The protective cover of claim 1, wherein the at least one partially open compression fit tube further comprising an installation slit.

5. The protective cover of claim 4, further comprising:

a smooth upper surface to interface with the tent canopy and an underside to engage the frame tent assembly.

6. The protective cover of claim 4, wherein the protective cover comprising thermoplastic material.

7. The protective cover of claim 4, further comprising a cavity configured to receive one or more junction attachment hardware.

8. The protective cover of claim 1, further comprising a cavity configured to receive one or more junction attachment hardware.

* * * * *